US006662806B2

(12) United States Patent
Nakane et al.

(10) Patent No.: US 6,662,806 B2
(45) Date of Patent: Dec. 16, 2003

(54) HAIRPIECE

(75) Inventors: Mariko Nakane, Suita (JP); Yuji Ota, Minoh (JP)

(73) Assignee: Proide Corporation, Osaka (JP)

( * ) Notice: Subject to any disclaimer, the term of this patent is extended or adjusted under 35 U.S.C. 154(b) by 0 days.

(21) Appl. No.: 09/924,984

(22) Filed: Aug. 9, 2001

(65) Prior Publication Data

US 2002/0056464 A1 May 16, 2002

(30) Foreign Application Priority Data

Nov. 13, 2000 (JP) ..... 2000-345850

(51) Int. Cl.[7] ..... A41G 3/00
(52) U.S. Cl. ..... 132/53; 2/174
(58) Field of Search ..... 132/53, 201, 54, 132/55, 56, 60, 57.1, 59, 72.1, 63.1, 65.1; 2/174

(56) References Cited

U.S. PATENT DOCUMENTS

| | | | | | |
|---|---|---|---|---|---|
| 2,317,207 | A | * | 4/1943 | Marck | 132/60 |
| 3,636,962 | A | * | 1/1972 | Frackowiak | 132/60 |
| 3,782,396 | A | * | 1/1974 | Tomlinson | 132/53 |
| 4,016,888 | A | * | 4/1977 | Smiley | 132/53 |
| 4,155,370 | A | * | 5/1979 | Nemoto | 132/53 |
| 4,168,713 | A | * | 9/1979 | Agiotis | 132/53 |
| 5,204,994 | A | * | 4/1993 | Herzberg et al. | 2/199 |
| 5,303,724 | A | * | 4/1994 | Anzivino | 132/278 |
| 5,419,345 | A | * | 5/1995 | Kadymir | 132/54 |

* cited by examiner

*Primary Examiner*—John J. Wilson
*Assistant Examiner*—Robyn Kien Doan
(74) *Attorney, Agent, or Firm*—Ronald E. Greigg

(57) ABSTRACT

The invention relates to the hairpiece to be attached to a cap removably. The clothing material of the hairpiece is implanted with hairs in width corresponding to the wearing angle of the different cap. The hairpiece is provided with the attachment for catching the cap and attaching the clothing material to the cap removably.

6 Claims, 6 Drawing Sheets

(a)

(b)

(a)

(b)

HAIRPIECE

BACKGROUND OF THE INVENTION

1. Field of the Invention

This invention relates to a hairpiece to be attached to a headwear such as a cap or a hat.

2. Prior Art of the Invention

Those who lost their hairs temporarily, for example, like a cancer patient, generally wear headwear attached with a wig or a wig covering over the whole head, when they go out.

Headwear with a wig is a cap or a hat in which hairs are directly implanted, a cap or a hat attached with a hairpiece of which hairs are implanted in a clothing material, or the like. Either one of the wig for the headwear can reduce the volume of hairs to be implanted comparing with that of a general wig, because the headwear covers the head. Accordingly, it is general that the wig for the headwear is cheaper than the wig covering over the whole head. Therefore, it is easy for those who infrequently use the wig to purchase the headwear with the wig rather than the wig covering over the whole head.

However, the headwear with the wig has a demerit that, since the wig cannot be removed from the headwear, the kind of headwear cannot be changed to others. Specifically, in case of the headwear with the wig in which hairs are directly implanted, if those who use the headwear with the wig desire to wear various kinds of headwear, they have to possess a plurality of the headwear with the wig because hairs are directly implanted to the headwear. Therefore, purchasing a plurality of headwear with the wig increases the expenses incurred.

In case of the headwear attached with hairpiece, it can be considered that only the hairpiece is removed from the headwear and attached to other headwear. However, since the wearing angle of headwear put on by a person changes according to the kind of headwear, attaching the removed hairpiece to other kind of headwear may cause the mismatch of the style.

SUMMARY OF THE INVENTION

Taking into consideration the above problems, the invention is proposed and has an object to provide a hairpiece that is configured simply and available for any kind of cap or hat.

In order to achieve the above-mentioned object, the invention adopts the following means.

That is to say, a clothing material for a hairpiece is implanted with hairs in width corresponding to the wearing angle of various kinds of headwear. And the hairpiece is provided with at least one attachment for attaching removably the clothing material to the headwear by catching a part of the headwear.

The attachments are provided with a phase of the closing material in which hairs are implanted. And the phase of the attachment being attached to the clothing material may be a curved phase fitting to a head shape.

DESCRIPTION OF THE PREFERRED EMBODIMENTS

The embodiment of the invention will be explained according to the drawings.

Figure 2:
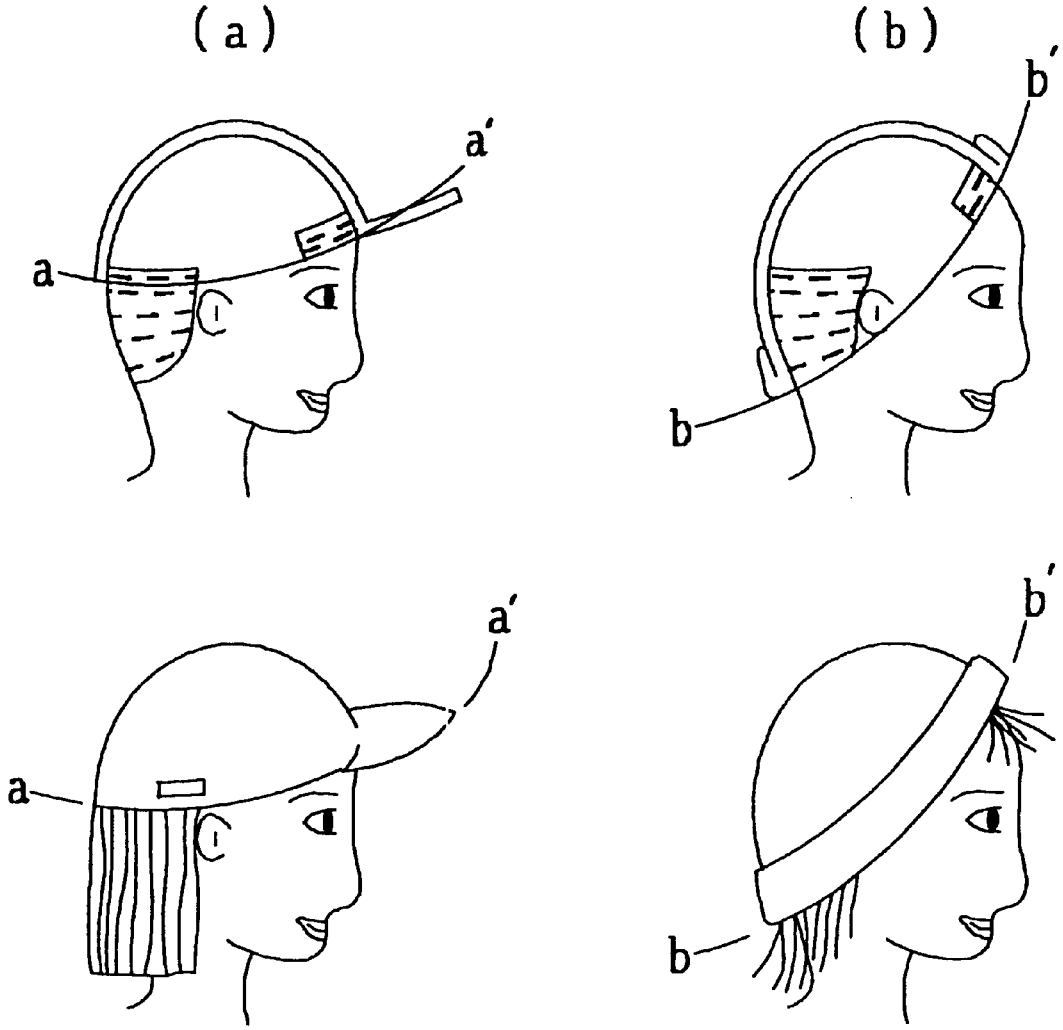
FIG. 2 is an explanatory diagram showing various kinds of headwear.

There are many kinds of headwear to be attached with a hairpiece, such as a baseball cap, a knitting cap, a hat and etc. According to the kind of headwear, the wearing angle when a person puts on the headwear may change. For instance, the baseball cap is put on along an approximate horizontal line a–a' as shown in FIG. 2(*a*). In this case, most the back of the head is exposed. On the other hand, the knitting cap is put on along the oblique line b–b' extending in the direction from the front to the back of the head as shown in FIG. 2(*b*). In this case, most the back of the head is covered by the cap. That is to say, it means that the minimum area covered by the hairpiece may change according to the kind of cap.

Figure 1:
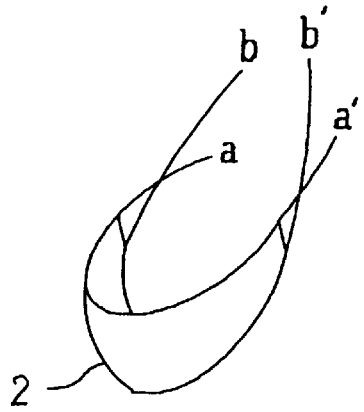
FIG. 1 is a perspective view of a hairpiece of the invention.
Figure 1:
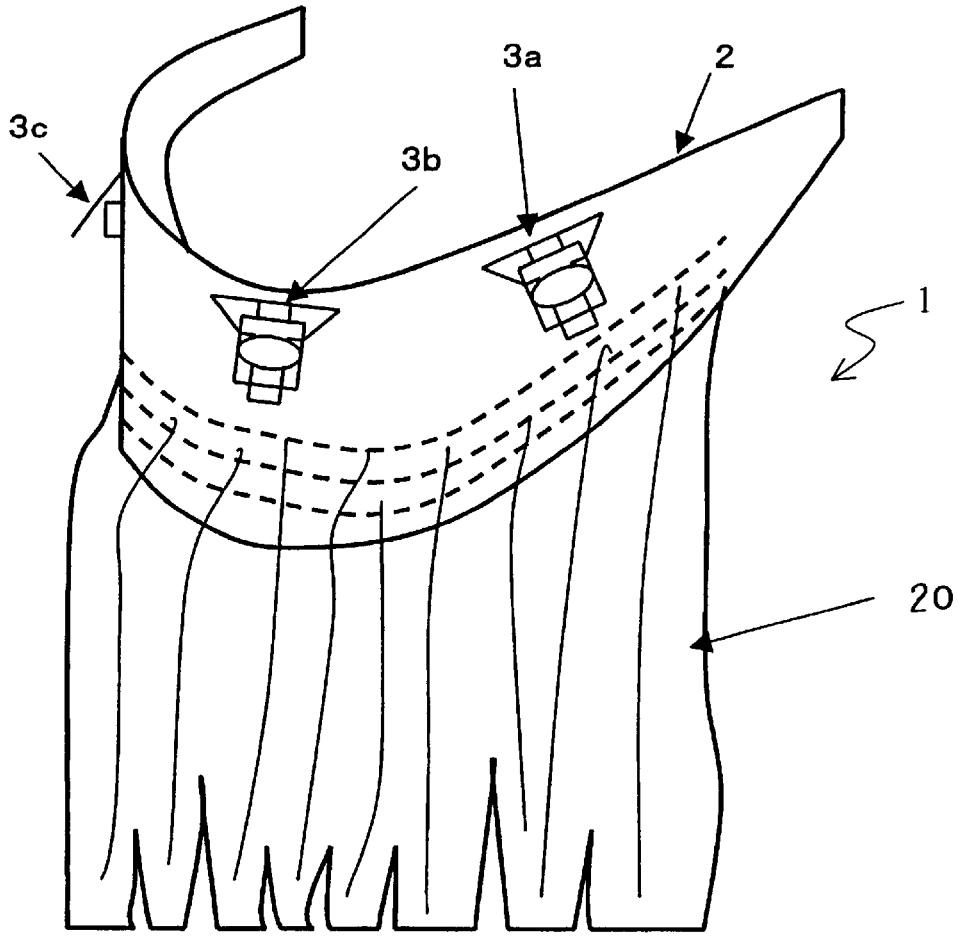

Therefore, in this embodiment of the invention, the width to be implanted with hairs is determined so as to be corresponding to at least the width enclosed with the approximate horizontal line a–a' and the oblique line b–b' shown in FIG. 1(*a*). As shown in FIG. 1(*b*), the hairs 20 are implanted in a base 2 like the clothing material.

A hairpiece 1 shown in FIG. 1(*b*) is for the back of the head. The hairpiece 1 is provided with at least one attachment 3 in addition to the base 2 implanted with hairs 20. In this embodiment, three attachments 3*a*, 3*b* and 3*c* are provided with the upper side over a part implanted with hairs 20 of the base 2. The method of attaching the attachment 3 to the base 2 may be either way to sew or to glue the attachment 3 on the base 2.

Figure 3:
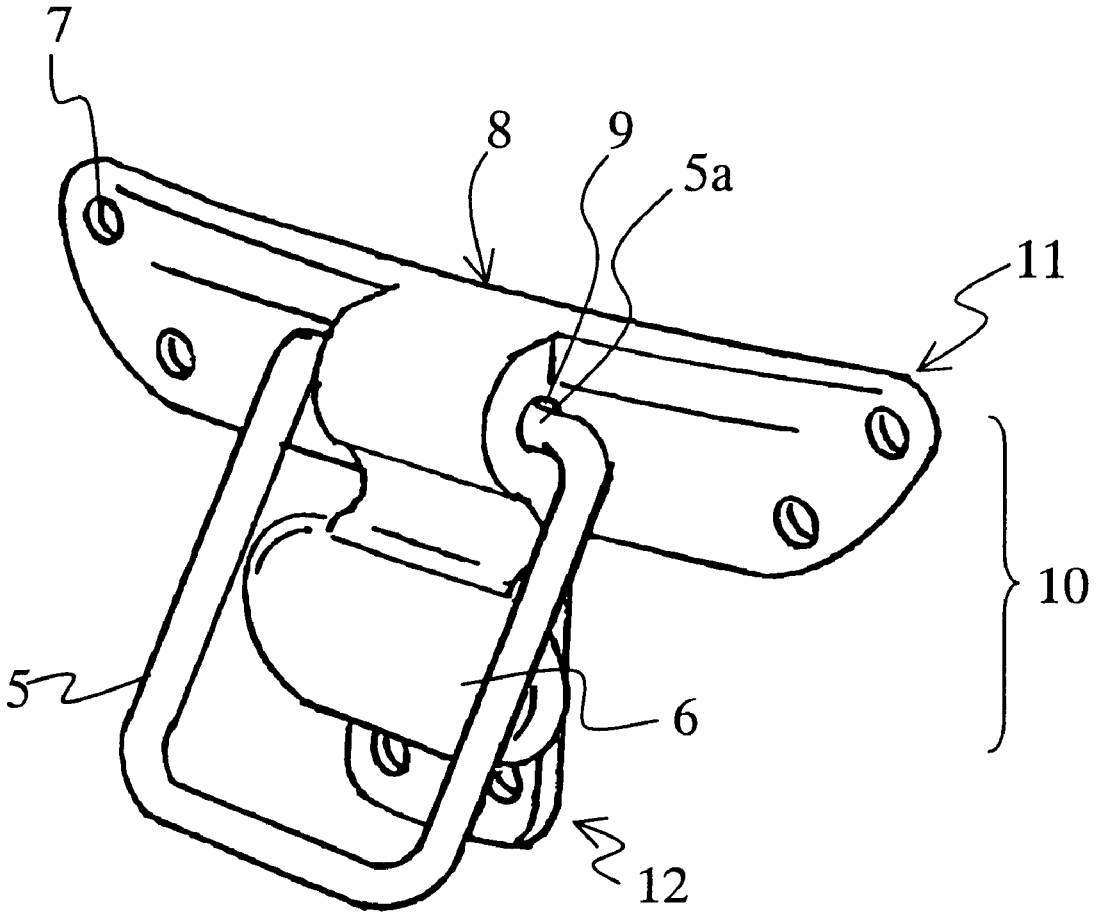
FIG. 3 is a perspective view of an attachment with which the hairpiece of the invention is provided.
Figure 4:
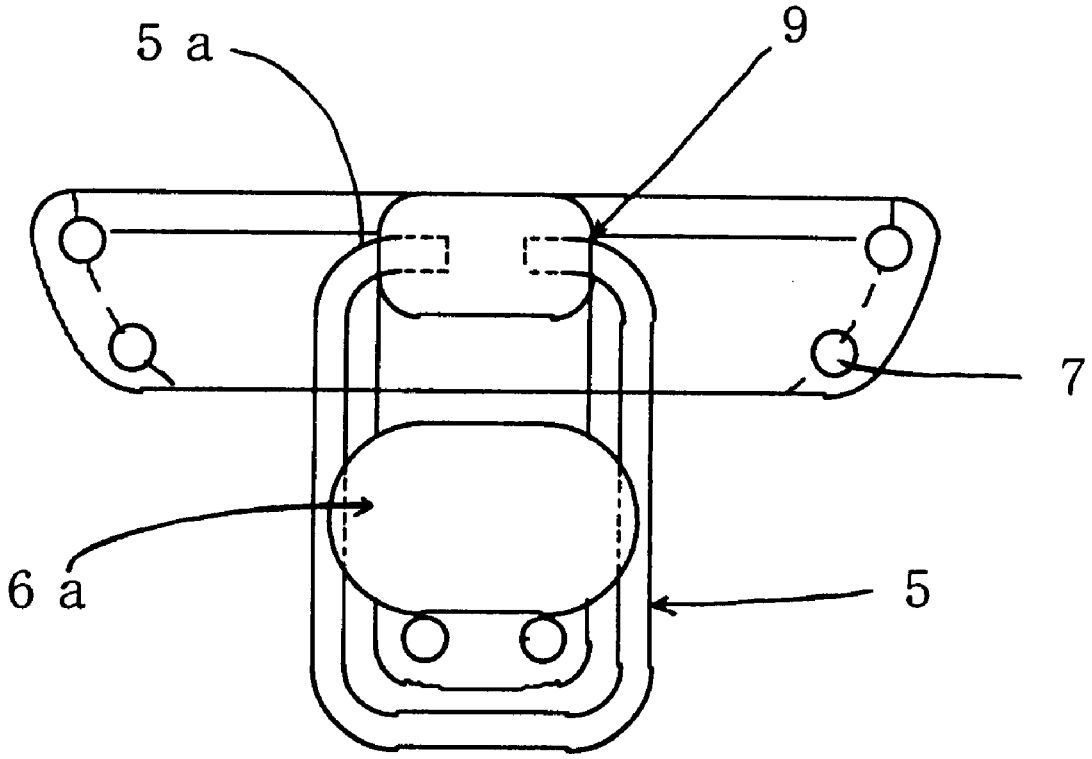
FIG. 4 is a schematic view of an attachment with which the hairpiece of the invention is provided.

The attachment 3 is provided with a T-shaped member 10 that a longitudinal member 11 in the direction from left to right and a longitudinal member 12 in the direction from top to down are formed into one unit as shown in FIG. 3 and FIG. 4, for example. The upper end portion of the longitudinal member 12 is provided with an attachment hole 9 for attaching a clip 5.

The clip 5 is shaped like one of short sides of a rectangle (which is called a base end 5*a*) is opening. The opening end of the clip 5 is fitted to the attachment hole 9. Therefore, the clip 5 can be attached to the longitudinal member 12 rotatably around the axis of the base end 5*a*.

Besides, the longitudinal member 12 is provided with a clipping projection 6 of which the head portion 6*a* is wider than the short side of the clip 5. When the clip 5 is rotated to the side of the longitudinal 12, the long side of the clip 5 touches to the head portion 6*a* of the clipping projection 6.

If a material provided with a specific elasticity is used as the clip 5, when the clip 5 is pushed down in the direction of the clipping projection 6 by a finger of a person, the clip 5 transforms elastically. The clip 5 is extended for the width of the clipping projection 6 by the elastic transform, and then returns to be the original shape. At this time, the clip 5 is fixed to the head portion 6*a* as shown in FIG. 4.

If the shape of the head portion 6*a* is an elliptic plate, for example, the clip 5 can be pressed into the side of the head portion 6*a* in easy. Beside, the shape and the size of the clip 5 and the clipping projection 5 are not restricted to the above example.

In addition, the both ends of the longitudinal member 11 and the bottom end of the longitudinal 12 are provided respectively with an attachment hole 7 for attaching the attachment 3 to the base 2. Those attachment holes 7 are used when the attachment 3 is sewed on the base 2 .

The phase 8 on which the attachment 3 is attached to the base 2 is an opposite side of the phase provided with the clip 5. The phase 8 of the attachment 3 being attached to the base 2 is formed in the shape corresponding to the shape of the head of a human being (in this embodiment, the back of the head).

By using such attachment 3, the base 2 is attached to the cap. The followings take and explain a case when the hairpiece is attached to a baseball cap as an example.

Figure 5:
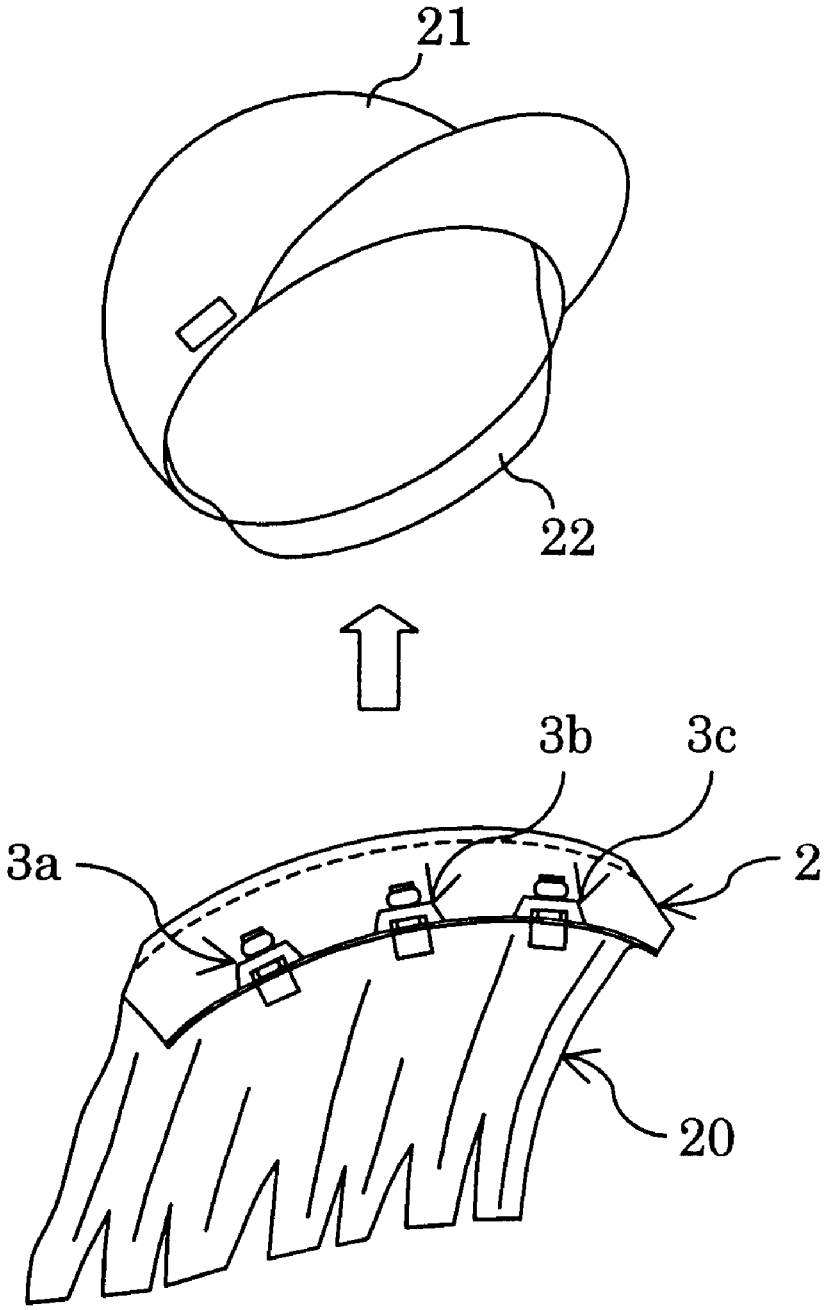
FIG. 5 is an explanatory diagram showing a method that the hairpiece of the invention is attached to a sweatband of headwear.

Generally, the cap is provided in its inside with a sweatband in order to form the shape of cap and to receive the sweat from the head. The sweatband is sewed on the inside circumference of the opening portion of the cap. When the hairpiece is attached to the cap, the sweatband 22 of the back of head of the cap 21 is turned over to outside as shown in FIG. 5. On the other hand, each clip 5 of the attachments 3*a*, 3*b* and 3*c* of the hairpiece 1 is rotated in the direction apart from the clipping projection 6. The position of the hairpiece 1 is adjusted to the cap 21 so as to meet the head portion 6*a* to the sweatband 22.

Next, by rotating each clip 5 of the attachment 3*a*, 3*b* and 3*c*, the sweatband 22 is caught by the clip 5 and the clipping projection 6. And then the clip 5 is pressed down into the clipping projection 6. Thereby, while the sweatband 22 is caught by the clip 5 and the clipping projection 6, the position of the clip 5 is fixed, so that the hairpiece may be attached to the sweatband 22.

Figure 6:
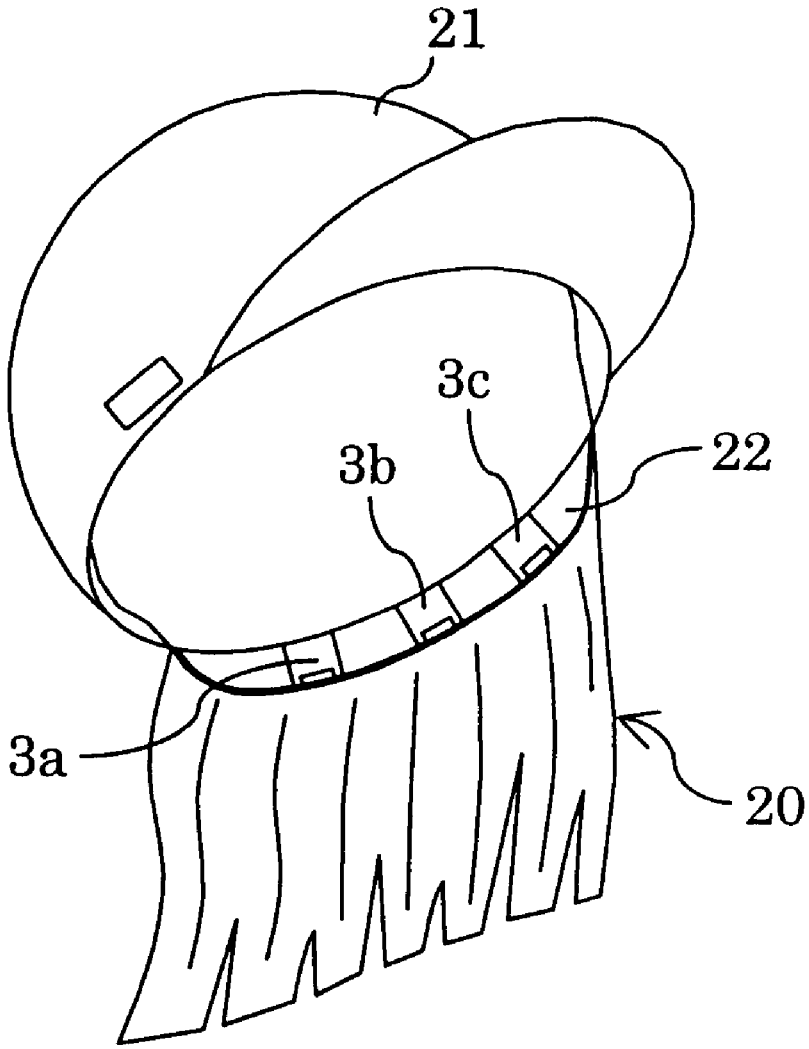
FIG. 6 is an explanatory diagram showing a state that the hairpiece of the invention is attached to a sweatband of headwear.

After that, the sweatband 22 attached with the hairpiece 1 goes back to the original state as shown in FIG. 6; thereby the hairpiece 1 is sure to be attached to the cap 21.

When the hairpiece is attached to the cap 21 as described above, each attachment 3*a*, 3*b* and 3*c* and the implanted hairs 20 are caught between the sweatband 22 and the base 2. That is to say, each attachment 3*a*, 3*b* and 3*c* and the implanted hairs 20 do not touch directly on the head skin of a person. Since the attachment phase 8 of each attachment 3*a*, 3*b* and 3*c* is curved corresponding to the shape of the head of a person, when a person wears the cap 21 attached with the hairpiece 1 on his head, it is possible to suppress the unnatural feeling caused by the attachment 3*a*, 3*b* and 3*c*. The appearance when a person puts on the cap 21 is not peculiar. Moreover, since the hairpiece 1 is caught between the sweatband 22 and the head of a person, it is hard to remove the hairpiece from the cap by the friction.

The hairpiece 1 attached to the cap 21 can be removed from the cap 21 by releasing the sweatband 22 caught by the clip 5 and the clipping projection 6.

It is needless to say that the hairpiece 1 can be attached to the other kind of caps like the knitting cap. In addition, the part to be attached with the hairpiece 1 is not restricted to the sweatband of the cap.

For instance, when the hairpiece 1 is attached to the sweatband of the knitting cap, the length of hairs looks like long as compared with the state when the hairpiece 1 is attached to the baseball cap. At this time, if the person feels unnatural, the hairpiece 1 may be attached to the side near to the top of the head. Thereby, it is possible to reduce the unnatural feeling. In this case, the hairpiece 1 may be attached to the headwear by catching the lining of the headwear between the clip 5 and the clipping projection 6, instead of the sweatband. Besides, the hairpiece 1 may not be directly attached to the headwear but be attached a clothing material or the like sewed on the headwear separately.

By using the attachment 3 as described above, it is possible to attach the hairpiece 1 to various kinds of headwear and any position of the headwear. Since the width of the clothing material to which the hairs 20 are implanted is ensured corresponding to the wearing angle of the various kinds of the headwear, it is possible to avoid the exposure of the part without being implanted with the hairs when a person wearing the headwear attached with the hairpiece. Moreover, the apparent length of the hairs 20 may be adjusted by arranging the position of the base 2 where the attachment 3 is attached.

Besides, when the hairpiece is attached to the front side of the cap, it may be arranged that the hairs corresponding to the front hairs be implanted in the base.

Moreover, the hairpiece of the invention is not restricted to those who lost hairs. Since the color, the length, style of the hairpiece can be changed as a user likes, the hairpiece can be available for the fashionable use.

What is claimed is:

1. A hairpiece which comprises:

a clothing material being implanted with hairs, and having a width which corresponds to the wearing angle of various kinds of headwear, the headwear having a sweatband; and at least one attachment means provided on the clothing material for clasping the sweatband of the headwear to removably attach the clothing material to the headwear, the attachment means including a central portion and a curved section on each side of the central portion, each of which curved sections are attached to the hairpiece, and the central portion having a pivotable loop and an extension, said pivotable loop and extension clasping the sweatband of the headwear and locking the hairpiece to the sweatband of the headwear.

2. A hairpiece according to claim 1, wherein the clothing material has a curvature and the at least one attachment has a curvature which matches the curvature of the clothing material.

3. A hairpiece according to claim 2, wherein the at least one attachment has a curvature which generally matches the shape of the wearers head.

4. A hairpiece which comprises:

a clothing material being implanted with hairs, the clothing material having a width which corresponds to the wearing angle of various kinds of headwear, the headwear having a sweatband;

and at least one attachment means provided on the clothing material for clasping the sweatband of the headwear to removably attach the clothing material to the headwear, the attachment means including a central portion and a section on each side of the central portion, each of which sections include means to attache the attachment means to the hairpiece, and the central portion having a pivotable loop and an extension, said pivotable loop having a position in which it engages the extension so as to clasp the sweatband of the headwear and hold the hairpiece to the sweatband of the headwear.

5. A hairpiece according to claim 4, wherein the clothing material has a curvature, and the at least one attachment means is provided with a curvature which matches the curvature of the clothing material.

6. A hairpiece according to claim 5, wherein the at least one attachment means has a curvature which generally matches the shape of the wearers head.

* * * * *